US007584106B1

(12) United States Patent
Cox et al.

(10) Patent No.: US 7,584,106 B1
(45) Date of Patent: Sep. 1, 2009

(54) METHOD AND APPARATUS FOR REDUCING ACCESS DELAY IN DISCONTINUOUS TRANSMISSION PACKET TELEPHONY SYSTEMS

(75) Inventors: Piotr Vandervoort Cox, New Providence, NJ (US); David A. Kapilow, Berkeley Heights, NJ (US)

(73) Assignee: AT&T Intellectual Property II, L.P., New York, NY (US)

( * ) Notice: Subject to any disclaimer, the term of this patent is extended or adjusted under 35 U.S.C. 154(b) by 0 days.

(21) Appl. No.: 11/675,278

(22) Filed: Feb. 15, 2007

Related U.S. Application Data

(63) Continuation of application No. 11/190,434, filed on Jul. 27, 2005, now Pat. No. 7,197,464, which is a continuation of application No. 09/769,119, filed on Jan. 25, 2001, now Pat. No. 7,016,850.

(60) Provisional application No. 60/178,094, filed on Jan. 26, 2000.

(51) Int. Cl.
*G10L 21/04* (2006.01)
*G10L 21/00* (2006.01)

(52) U.S. Cl. ..... 704/503; 704/201; 704/211

(58) Field of Classification Search ..... None
See application file for complete search history.

(56) References Cited

U.S. PATENT DOCUMENTS

| | | | |
|---|---|---|---|
| 5,216,744 | A | 6/1993 | Alleyne et al. |
| 5,386,493 | A | 1/1995 | Degen et al. |
| 5,555,447 | A | 9/1996 | Kotzin et al. |
| 5,706,393 | A | 1/1998 | Ehara |
| 5,796,719 | A | 8/1998 | Peris et al. |
| 5,806,023 | A | 9/1998 | Satyamurti |
| 6,484,137 | B1 | 11/2002 | Taniguchi et al. |

OTHER PUBLICATIONS

"Real-time implementation of time domain harmonic scaling of speech for rate modification and coding", R. Cox et al., Acoustics, Speech and Signal Processing, IEEE Transactions, vol. 31, Issue 1, Feb. 1983, pp. 258-272.

"High quality time-scale modification for speech", S. Roucos et al., Acoustics, Speech and Signal Processing, IEEE International Conference on ICASSP '85, vol. 10, Apr. 1985, pp. 493-496.

*Primary Examiner*—David R Hudspeth
*Assistant Examiner*—Brian L Albertalli

(57) ABSTRACT

A system, method and computer-readable medium are disclosed for operating a communications network. The method aspect comprises receiving a signal and removing a first portion of a frame of the signal, and generating an overlap-added segment from (1) a first segment of the frame, the first segment being located before the first portion; and (2) a second segment of the frame, the second segment comprising an endmost portion of a terminal section of the frame. The method preferably operates in a discontinuous transmission packet telephony network having a channel access delay.

11 Claims, No Drawings

METHOD AND APPARATUS FOR REDUCING ACCESS DELAY IN DISCONTINUOUS TRANSMISSION PACKET TELEPHONY SYSTEMS

RELATED APPLICATIONS

The present application is a continuation of U.S. patent Ser. No. 11/190,434, filed Jul. 27, 2005, now U.S. Pat. No. 7,197,464 which is a continuation of U.S. patent application Ser. No. 09/769,119, filed Jan. 25, 2001, now U.S. Pat. No. 7,016,850 which claims priority to U.S. Provisional Application No. 60/178,094, filed Jan. 26, 2000.

No drawings are filed with this application. Additional information and drawings to assist in understanding the invention may be found in the parent case, issued as U.S. Pat. No. 7,197,464.

TECHNICAL FIELD

The present invention is related to methods and devices for use in cell phones and other communication systems that use statistical multiplexing wherein channels are dynamically allocated to carry each talkspurt. It is particularly directed to methods and devices for mitigating the effects of access delay in such communication systems.

BACKGROUND OF THE INVENTION

In certain packet telephony systems, a terminal only transmits when voice activity is present. Such discontinuous transmission (DTX) packet telephony systems allow for greater system capacity, as compared with systems in which a channel is allocated to a transmitting terminal for the duration of the call, or session.

In DTX systems, at the start of each talkspurt, the transmitting device, typically a wireless handset, requests a transmission channel from the base station. The base station, which uses statistical multiplexing for allocating channels, establishes a path via a network and/or intermediate switches to connect to the remote receiving device, which may be another handset, conventional land-line phone, or the like.

The principal functions of the transmitting device and the base station in a DTX system are discussed below. A speaker=s voice is received by an audio input port (AIP) where the voice signal is digitally sampled at some frequency fs, typically fs=8 kHz. The sampled signal is usually divided into frames of length 10 msec or so (i.e., 80 samples) prior to further processing. The frames are input to a voice activity detector (VAD) and a speech encoder. As is known to those skilled in the art, in some devices, the VAD is integrated into the speech encoder, although this is not a requirement in prior art systems. In any event, the VAD determines whether or not speech is present and, if so, sends an active signal to the handset=s control interface. The handset=s control interface sends a traffic channel request over the control channel to the traffic channel manager resident in the base station. In response to the request, the traffic channel manager eventually sends back a traffic channel grant to the handset=s control interface, using the control channel. Upon receiving the traffic channel grant, the handset=s control interface notifies the VAD, the speech encoder and/or the handset=s bit-stream transmitter that a traffic channel has been allocated for transmitting voice data. When this happens, the speech encoder encodes the speech frames and sends the encoded speech signal to the handset=s bit-stream transmitter for transmission over the traffic channel to the appropriate bit-stream receiver associated with the base station. In some devices, the speech encoder prepares frames for transmission and sends these to the bit-stream transmitter, whether or not there is voice information to be transmitted. In such case, the transmitter does not transmit until it receives a signal indicating that the traffic channel is available.

In the above-described conventional system, there is delay between the time that frames emerge from the audio input port and the bit-stream transmitter begins to transmit voice data. The overall delay includes a first delay associated with the time that it takes the VAD to detect that voice activity is present and notify the handset=s control interface prior to the traffic channel request, the AVAD delay@, and a second delay associated, with the time between the traffic channel request and the traffic channel grant, the Achannel access delay@. The length of the VAD delay is fixed for a given handset, and depends on such things as the frame length being used. The length of the channel access delay, however, varies from talkspurt to talkspurt and depends on such factors as the system architecture and the system load. For example, in the wireless voice over EDGE (Enhanced Data for GSM Evolution) system, the channel access delay is approximately 60 msec, and possibly more. Conventionally, mitigating any type of access delay entails either a) buffering the voice bit-stream until permission is granted, and thereby retarding transmission by that amount of time, b) throwing away speech at the beginning of each utterance (Ai.e., Afront-end clipping@) until permission is granted, or c) a combination of the two approaches. The buffering option introduces delay, which is detrimental to the dynamics of interactive conversations. Indeed, adding 120 msec of round trip delay just for access delay can break the overall delay budget for the system. The front-end clipping option often cuts off the initial consonant of each utterance, and thus hurts intelligibility. Finally, combining the two options such that less clipping occurs at the expense of delay is less than satisfactory because such an approach suffers from the disadvantages of both.

SUMMARY OF THE INVENTION

The present invention is directed to a method for removing access delay during the beginning of each utterance as the talkspurt progresses. This is done by time-scale compressing, i.e., speeding up, the speech at the start of a talkspurt before it is passed to the speech coder. The speech is speeded up by buffering each talkspurt, estimating the speaker s pitch period, and then deleting an integer number of pitch period=s worth of speech from the buffered talkspurt to produce a compressed talkspurt. The compressed talkspurt is then encoded and transmitted until the access delay has been fully mitigated, after which the incoming voice signal is passed through without further compression for the remainder of the talkspurt.

In one aspect of the present invention, the speech is speeded up by between 10-15%, so that a 60 msec delay is mitigated between the first 400-600 msec of a talkspurt.

DETAILED DESCRIPTION OF THE INVENTION

With reference to the communication device and the base station, a speaker speaks into the AIP which, in turn, outputs frames of speech. The frames of speech are input to both the Voice Activity Detector (VAD) and the Access Delay Reducer (ADR). The VAD makes a binary yes/no decision as to whether or not each input frame contains voice activity. If voice activity is detected, the speech frames are encoded by the speech encoder and transmitted by the bit-stream transmitter via the traffic channel to the bit-stream receiver of the base station. On the other hand, when the VAD detects no voice activity, the bit-stream transmitter transmits no voice signal, although it may still transmit frames for comfort noise generation (CNG), such as described in U.S. Pat. No. 5,960,389, during such periods of inactivity so that the background noise at the receiver matches that at the transmitter.

The VAD outputs an active signal, which indicates an inactive-to-active transition, both to the handset=s control interface and the ADR, thereby signifying that voice frames are present. The handset=s control interface, in turn, informs the traffic channel manager via the control channel that a traffic channel is needed to send the bit-stream. The traffic channel manager, in turn, locates and allocates an available traffic channel and, after the access delay, Da, informs the handset=s control interface by sending an appropriate message back over the control channel, which is sent on to the ADR. The traffic channel is requested and assigned by the traffic channel manager at the start of each talkspurt. At the end of each talkspurt, the VAD detects that no further speech is being generated, and sends an appropriate signal to the handset=s control interface which, in turn, informs the traffic channel manager that the assigned traffic channel is no longer needed and now may be reused.

When the ADR receives the active signal from the VAD, it starts buffering the frames of speech in an internal buffer. And when the ADR receives the signal from the control interface, it can determine the access delay Da. This can be done, for example, by use of a real time clock/timer associated with the communication device, or by measuring a >current position= pointer in the AIP both upon receiving the active signal (>voice present=) from the VAD and also upon receiving the second signal (>channel established=), and taking the difference. In general the particular manner in which the ADR obtains the channel delay is not critical, so long as it has access to this information.

In the present invention, the ADR is configured to speed up the speech at the beginning of each utterance so as to make up for the access delay Da within some time period T. This is accomplished by compressing the speech by some speed-up rate r during the time period T. The speed-up rate r at which the access delay Da is mitigated is given by $r=Da/T$. It should be noted, however, that the speed-up rate r is a tunable parameter which may be selected, given latitude in adaptively determining T, upon ascertaining the delay access Da. Higher speed-up rates remove the access delay faster, but at the expense of noticeably more distorted output speech. Lower speed-up rates are less noticeable in the output speech, but take longer to remove the delay. Preferably, $0.08<r<0.15$, and most preferably $\tilde{r}0.12$, or 12%. Thus, in the most preferred embodiment, an access delay of Da=60 msec is mitigated in a time-scaling interval T=500 msec, preferably near the beginning of each talkspurt. Should the utterance then continue, no further mitigation is required since the time-scale compression during the time period T would have accounted for the entire access delay. The output of the ADR is sent to the speech encoder in preparation for transmission by the bit-stream transmitter.

To maintain proper signal phase in voiced regions, preferably, only segments that are an integer number of estimated pitch periods are cut from the signal. In regions with long pitch periods where only a little bit needs to be removed, the cutting is deferred until the pitch period drops. Thus, it may take a little longer than a predetermined time-scaling interval T allotted for fully mitigating the access delay.

In the context of the present invention, the VAD preferably is external to the speech encoder, rather than being part of the speech encoder, as in conventional implementations. This is because the speech must be time-scaled before it is sent to the speech encoder, which requires that the output of the VAD be known before the encoder is called into play. Furthermore, while the ADR could be integrated into an encoder, it is simpler to implement it as a preprocessor. This way, a single ADR implementation may be used with any speech encoder.

Described below is a method to operate a communication device in accordance with the present invention. First, the communication device is turned on and the AIP outputs frames of data, whether or not voice is present. Second, the VAD and the ADR both receive the frames output by the AIP, with the ADR temporarily buffering the frames, just in case the VAD determines that voice activity was present. Third, the VAD checks for voice activity. If no voice activity is detected, additional frames are taken in and buffered and checked. If voice activity is detected, fourth, the VAD sends an active signal to the control interface and also to the ADR. Fifth, the control interface requests a channel and sixth, informs the ADR and the bit-stream transmitter that a channel has been allocated for the current talkspurt. Seventh, the ADR obtains the access delay and determines the number of samples that it must cut from the talkspurt within the time period T. Eighth, the ADR processes new frames from the AIP, cutting samples in accordance with a predetermined algorithm, and sends the cut frames onto to the speech encoder in preparation for transmission. Ninth, the ADR checks to see whether a sufficient number of samples have been cut. If not, control returns to the eighth step to process and make cuts in additional frames. If, however, it is determined at the ninth step that a sufficient number of samples have been cut, tenth, the remaining frames are passed through to the encoder without further cutting until, eleventh, the VAD indicates that no further voice activity is being received in that talkspurt.

After the talkspurt is over, an active-to-inactive transition occurs in the VAD and the VAD sends an inactive signal to the handset=s control interface. When the handset=s control interface receives and processes the inactive signal, this ultimately results in the traffic channel being freed for reuse by the base station. The handset=s control interface then waits for another active signal from the VAD, in response to another talkspurt. However, if the talkspurt is very short, e.g., less than the time period T of 500 msec, the system may not have enough time to completely remove the access delay. In this case, the bit-stream transmitter informs the handset=s control interface that there is still data to send, which may defer freeing the traffic channel until all the encoded packets have been transmitted.

The substeps comprising the above eighth step are discussed below. In the first substep, the ADR receives a frame from the AIP. In the second substep, the ADR determines the pitch period P using the most recent portion of the received frame. Preferably, this is done by performing an autocorrelation of a terminal section of the frame, with earlier portions of that frame, and perhaps even earlier frames, by using various lags within some finite range. The lag corresponding to the peak of the resulting autocorrelation output is then taken as the pitch period P. The pitch period estimate P is used even when the speech is unvoiced. In the third substep, the ADR subtracts one pitch period P worth of signal from the frame, although integer multiples of a single pitch period may be subtracted, if P is short enough. After the pitch period has been cut, a first segment of the frame located immediately before the cut portion, and a second segment of the frame comprising an endmost portion of the cut portion are merged. As seen in the fourth substep, this is preferably done by an overlap-add technique which mixes the two segments so as to ensure a smooth transition. Finally, in the fifth substep, the cut frame is sent on to the speech encoder 156 in preparation for transmission of the cut frame.

It should be noted here that while the above description focuses on the access delay reducer being found in a handset, a similar functionality could also be found in a base station which must first establish/allocate a traffic channel before relaying a voice signal to the handset, and therefore must buffer and transmit the voice signal. In such case, access delay reduction may be employed in both directions.

Attached as Appendix 1 is sample c++ source code for a floating-point implementation of an access delay reduction algorithm in accordance with the present invention.

While the above description is principally directed to wireless applications, such as cellular telephones, it should be kept in mind that time-scale compression of speech has applications in other settings, as well. In general, the principles of the present invention find use in any type of voice communication system in which statistical multiplexing of channels is performed. Thus, for example, the present invention may be of use in Digital Circuit Multiplication Equipment and also in Packet Circuit Multiplication Equipment, both of which are used to share voice channels in long distance cables, such as undersea cables.

And while the above invention has been described with reference to certain preferred embodiments, it should be kept in mind that the scope of the present invention is not limited to these. One skilled in the art may find variations of these preferred embodiments which, nevertheless, fall within the spirit of the present invention, whose scope is defined by the claims set forth below.

What is claimed is:

1. A computer-implemented method for operating a communications network, the method comprising:

receiving a signal and removing a first portion of a frame of the signal; and generating an overlap-added segment from (1) a first segment of the frame, the first segment being located before the first portion; and (2) a second segment of the frame, the second segment comprising an endmost portion of a terminal section of the frame.

2. The computer-implemented method of claim 1, wherein receiving the signal and removing a first portion of a frame of the signal and generating an overlap-added segment are performed by an access delay reducer.

3. The computer-implemented method of claim 1, wherein method is practiced in a discontinuous transmission packet telephony network having a channel access delay.

4. The computer-implemented method of claim 1, wherein receiving the signal and removing a first portion of a frame of the signal further forms a time-scaled frame, wherein the first portion comprises an integer number of a pitch period's worth of the signal.

5. The computer-implemented method of claim 4, wherein receiving the signal and removing a first portion of a frame of the signal further forms the overlap-added segment at an end portion of the time-scaled frame.

6. The computer-implemented method of claim 1, wherein the signal is a voice signal.

7. The computer-implemented method of claim 1, wherein receiving the signal and removing a first portion of a frame of the signal removes the first portion from a terminal section of the frame.

8. The computer-implemented method of claim 1, wherein generating an overlap-added segment further comprises multiplying the first segment and the second segment by a window and adding them together to form the overlap-added segment.

9. The computer-implemented method of claim 1, wherein receiving the signal and removing a first portion of a frame of the signal removes the first portion from the frame even if the first portion comprises unvoiced speech.

10. A tangible computer-readable medium storing instructions for controlling a computing device to operate a communications network, the instructions comprises:

receiving a signal and removing a first portion of a frame of the signal; and generating an overlap-added segment from (1) a first segment of the frame, the first segment being located before the first portion; and (2) a second segment of the frame, the second segment comprising an endmost portion of a terminal section of the frame.

11. The tangible computer-readable medium of claim 10, wherein receiving the signal and removing a first portion of a frame of the signal and generating an overlap-added segment are performed by an access delay reducer.

* * * * *